US006321947B2

(12) United States Patent
Gross et al.

(10) Patent No.: US 6,321,947 B2
(45) Date of Patent: Nov. 27, 2001

(54) MULTIPLE DISPENSING VALVE CLOSURE WITH THREADED ATTACHMENT TO A CONTAINER AND WITH A TWIST-OPEN SPOUT

(75) Inventors: Richard A. Gross, Oconomowoc; Daniel G. Schantz, Muskego; Alan P. Hickok, Waukesha, all of WI (US); Timothy R. Socier, Essexville, MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/747,745

(22) Filed: Dec. 22, 2000

Related U.S. Application Data

(63) Continuation-in-part of application No. 09/502,630, filed on Feb. 11, 2000.

(51) Int. Cl.[7] ..... B67D 5/60

(52) U.S. Cl. ..... 222/145.1; 222/145.5; 222/490; 222/521

(58) Field of Search ..... 222/94, 145.1, 222/145.5, 490, 494, 521

(56) References Cited

U.S. PATENT DOCUMENTS

| | | |
|---|---|---|
| 4,753,536 | 6/1988 | Spehar et al. . |
| 4,964,539 | 10/1990 | Mueller . |
| 5,102,016 | 4/1992 | Ball et al. . |

(List continued on next page.)

FOREIGN PATENT DOCUMENTS 0 759 876 B1 3/1997 (EP) .

OTHER PUBLICATIONS

U.S. Application No. 09/157,706, filed Sep. 21, 1998.

U.S. Application No. 09/352,172, filed Jul. 12, 1999.

U.S. Application No. 09/502,630, filed Feb. 11, 2000.

FIG. A is a copy of a portion of FIG. 2 of the instant application.

FIG. B is a copy of a portion of FIG. 3 of the instant application.

*Primary Examiner*—Philippe Derakshani
*Assistant Examiner*—Thach H. Bui
(74) *Attorney, Agent, or Firm*—Rockey, Milanow & Katz, Ltd.

(57) ABSTRACT

In a dispensing system comprising a container having at least two storage chambers, each for a fluent material, the finishes of the respective chambers are arranged in a contiguous pair defining a cylindrical surface having outer threads, except for two anti-rotational flats. Each finish defines an outlet. A valve of a type that remains closed until opened by a differential between inside pressure and outside pressure overlies the outlet defined by each finish. A fitment defines a mixing chamber having two inlets, one for each storage chamber, and having an outlet. The fitment has two skirts, each having an inner surface having at least one rib, each defining an anti-rotational flat. The fitment fits over the paired finishes and over the valves so that the antirotational flats on the ribs engage the anti-rotational flats on the paired finishes. A collar having inner threads is threaded onto the paired finishes so as to hold the fitment, which holds the valves. Each valve has an elastomeric flange forming a seal between a margin of an associated outlet and a margin of an associated inlet. A dispensing spout is provided. The fitment and the dispensing spout have coacting formations, which permit the dispensing spout to be twisted in one rotational sense relative to the fitment so that the sealing formation of the dispensing spout engages the sealing formation of the fitment, to be twisted in the opposite sense relative to the fitment so that the sealing formation of the dispensing spout is disengaged from the sealing formation of the fitment, but not to become detached from the fitment.

10 Claims, 9 Drawing Sheets

U.S. PATENT DOCUMENTS

| | | | | |
|---|---|---|---|---|
| 5,137,178 | * | 8/1992 | Stokes et al. | 222/94 |
| 5,152,432 | | 10/1992 | Laforcade . | |
| 5,398,846 | | 3/1995 | Corba et al. . | |
| 5,611,463 | | 3/1997 | Favre . | |
| 5,615,803 | | 4/1997 | Hatakeyama et al. . | |
| 5,653,361 | | 8/1997 | Favre . | |
| 5,676,289 | | 10/1997 | Gross et al. . | |
| 5,680,969 | | 10/1997 | Gross . | |
| 5,833,121 | | 11/1998 | Gueret . | |
| 5,839,626 | | 11/1998 | Gross et al. . | |
| 5,873,494 | | 2/1999 | Dallas, Jr. . | |
| 5,938,086 | | 8/1999 | Gross . | |
| 5,954,213 | | 9/1999 | Douglas et al. . | |
| 6,065,642 | * | 5/2000 | Brown | 222/494 |

* cited by examiner

MULTIPLE DISPENSING VALVE CLOSURE WITH THREADED ATTACHMENT TO A CONTAINER AND WITH A TWIST-OPEN SPOUT

CROSS-REFERENCE TO RELATED APPLICATION

This application is a continuation-in-part of U.S. patent application Ser. No. 09/502,630, which was filed on Feb. 11, 2000, which is entitled "PACKAGE WITH MULTIPLE CHAMBERS AND VALVES," and the disclosure of which is incorporated herein by reference to the extent pertinent hereto and to the extent not inconsistent herewith.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention pertains to a dispensing system wherein fluent materials from at least two storage chambers, as in a squeezable dual-chambered container, are dispensed through valves of a type that remains closed until opened by a differential between inside pressure and outside pressure, and through a fitment defining a mixing chamber and mounted so as to overlie the valves.

BACKGROUND OF THE INVENTION AND TECHNICAL PROBLEMS POSED BY THE PRIOR ART

As exemplified in U.S. patent application Ser. No. 09/502,630, supra, a dispensing system is known, which comprises two chambers, each for a fluent material. A valve of the type noted above overlies an outlet of each chamber. The valves are mounted to a valve holder plate. A closure is provided, which includes a closure body, to which the valve holder plate is mounted via a snap-fit mounting engagement and which is mounted to the chambers via snap-fit mounting engagements. Reference is made to U.S. patent application Ser. No. 09/502,630, supra, for further information concerning the known system.

Such a system is useful for mixing and dispensing two fluent materials, either or both of which may be a liquid, an emulsion, or a powdered or granular material, particularly but not exclusively two fluent materials that react with each other and that cannot be pre-mixed. Such a system is useful if the containers are squeezable to increase their internal pressures, pressurized by internally stored pressures, or pressurizable by externally applied pressures, as from a pump.

Reference is made to U.S. Pat. No. 5,839,614 and U.S. patent application Ser. No. 09/432,677, the disclosures of which are incorporated herein by reference to the extent pertinent hereto and to the extent not inconsistent herewith, for further information concerning valves of the type noted above.

BRIEF SUMMARY OF THE INVENTION

This invention provides a dispensing system comprising a container having at least two storage chambers, each of which is designed to contain a fluent material, such as a liquid, an emulsion, or a powdered or granular material. Although two storage chambers are employed in a preferred embodiment to be later described, more than two storage chambers may be alternatively employed. Although a squeezable container is employed in the preferred embodiment, other containers that are pressurized by internally stored pressures or that are pressurizable by externally applied pressures, as from a pump, may be alternatively employed.

Each storage chamber has a finish defining an outlet. The finishes are arranged in a contiguous group, which is a contiguous pair if two storage chambers are used. The contiguous group of the finishes defines an outer surface having a portion conforming to a surface of revolution, preferably a circular cylinder and alternatively a cone. The contiguous group of the finishes defines outer threads on the portion conforming to the surface of revolution and defines an anti-rotational formation. The dispensing system further comprises at least two valves of the type noted above. Each valve overlies and is aligned with the outlet defined by the finish of an associated one of the storage chambers.

The dispensing system further comprises a fitment defining a mixing chamber, in which the fluent materials from the storage chambers are permitted to intermix. The fitment defines plural inlets into the mixing chamber and an outlet from the mixing chamber. Each inlet is associated with the outlet defined by the finish of an associated one of the storage chambers. The fitment has an anti-rotational formation, which is adapted to engage the anti-rotational formation of the outer surface of the contiguous group of the finishes so as to prevent relative rotation of the fitment and the contiguous group of the finishes when the anti-rotational formation of the fitment engages the anti-rotational formation of the contiguous group of the finishes.

The fitment fits over the valves overlying the outlets of the storage chambers and over the contiguous group of the finishes so that each inlet defined by the fitment overlies and is aligned with the valve overlying and being aligned with the associated outlet and so that the anti-rotational formation of the fitment engages the anti-rotational formation of the contiguous group of the finishes.

The dispensing system further comprises a collar having a skirt or lateral wall having inner threads. The inner threads are adapted to engage the outer threads of the contiguous group of the finishes and to hold the fitment, when the collar is threaded onto the fitment. The fitment holds the valves when the fitment is held by the collar.

Preferably, the outer surface defined by the contiguous group of the finishes has a portion that which is flatter than the portion conforming to the surface of revolution and that interrupts the outer threads, whereupon the anti-rotational formation of the contiguous group of the finishes comprises the flatter portion. Preferably, the fitment has a skirt having an inner surface having at least one formation conforming to the flatter portion, whereupon the anti-rotational formation of the fitment comprises the at least one conforming formation. In the preferred embodiment to be later described, the outer surface defined by the contiguous pair of the finishes has two substantially flat portions and the fitment has two skirts, each having an inner surface having at least two ribs having substantially flat surfaces conforming to the substantially flat portions.

Preferably, the fitment and the collar are configured so that the collar can be threaded onto the fitment but cannot be unthreaded from the fitment. In the preferred embodiment to be later described, the fitment has outer ratchet teeth and the collar has inner ratchet teeth, which coact with the outer ratchet teeth so as to permit the collar to be threaded onto the fitment but not to be unthreaded from the fitment.

Preferably, the dispensing system further comprises a dispensing spout, which has a sealing formation engageable with a sealing formation of the fitment to seal the outlet from the mixing chamber and disengageable from the sealing formation of the fitment to open the outlet from the mixing chamber, and which is adapted to dispense materials from the mixing chamber when the outlet from the mixing chamber is opened.

If the dispensing spout is employed, the fitment and the dispensing spout have coacting formations permitting the dispensing spout to be twisted in one rotational sense relative to the fitment so that the sealing formation of the dispensing spout engages the sealing formation of the fitment, permitting the dispensing spout to be twisted in the opposite sense relative to the fitment so that the sealing formation of the dispensing spout is disengaged from the sealing formation of the fitment, but not permitting the dispensing spout to become detached from the fitment.

Preferably, in the dispensing system, each finish defines a margin around the storage chamber outlet defined by such finish and the fitment defines a margin around each inlet defined by the fitment. Preferably, moreover, each valve has an elastomeric flange interposed and forming a seal between the margin around the outlet defined by the finish of the storage chamber associated with said valve and the margin around the inlet defined by the fitment and associated with said valve.

Preferably, in the dispensing system, the fitment defines a fitment sleeve meeting the margin of each inlet defined by the fitment, and each valve has a valve head at the end of a support wall or valve sleeve, which projects from the elastomeric flange of said valve. Preferably, moreover, the fitment sleeves and the valve sleeves have coacting formations enabling the valves to be snap-fitted into the sleeves.

As compared to prior dispensing systems, the dispensing system offers several significant advantages, some of which also are offered by the dispensing system disclosed in U.S. patent application Ser. No. 09/502,630, supra. One advantage is that the dispensing system permits the fluent materials to intermix in the fitment before being dispensed from the dispensing spout. Another advantage is that rotational misalignment is prevented when a sub-assembly comprising the fitment and the valves is threaded onto the finishes. A further advantage is that, as the sub-assembly cannot be readily removed from the finishes, the container cannot be readily refilled. Yet another advantage is that a so-called "shipping seal", as explained later herein, is provided.

Numerous other objects, features, and advantages of this invention will become readily apparent from the following detailed description, from the claims, and from the accompanying drawings.

BRIEF DESCRIPTION OF THE DRAWINGS

In the accompanying drawings, in which like numerals are employed to designate like parts throughout.

DESCRIPTION OF THE PREFERRED EMBODIMENT

Figure 1:
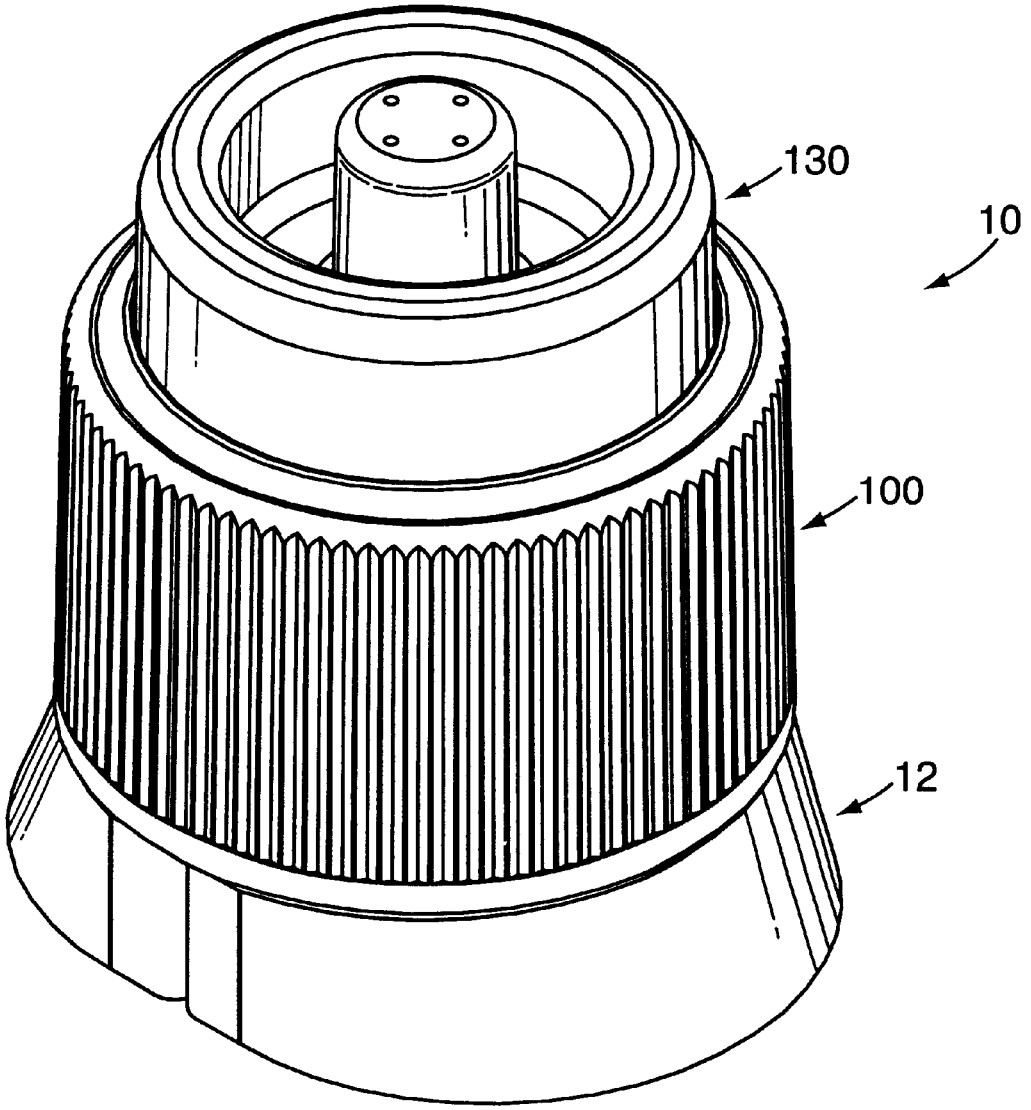
FIG. 1 is a fragmentary, perspective view of a squeezable, dual-chambered container embodying the dispensing system of this invention.
Figure 2:
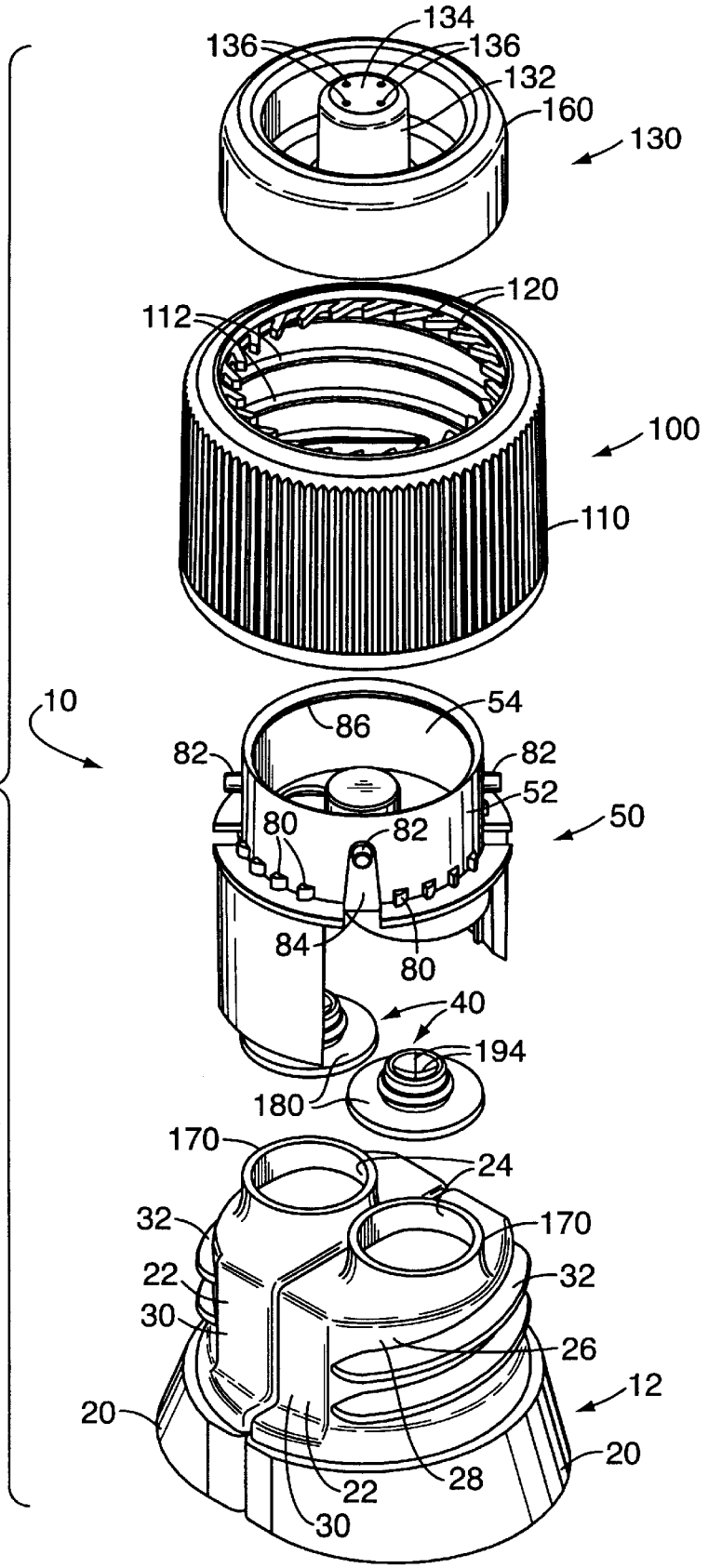
FIG. 2, on a smaller scale, is a fragmentary, exploded, perspective view of the squeezable, dual-chambered container.
Figure 3:
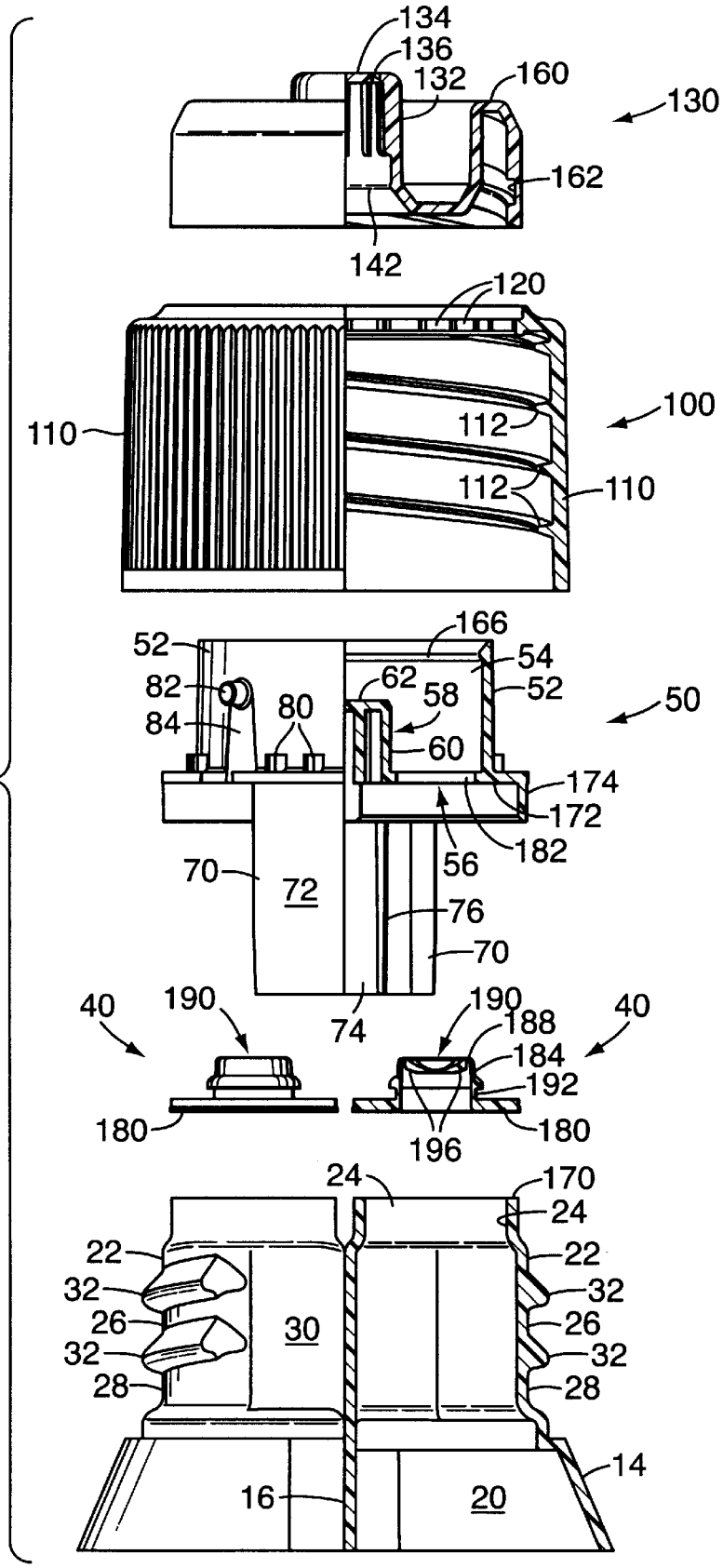
FIG. 3, on a similar scale, is an exploded, half-sectional, elevational view of the squeezable, dual-chambered container.
Figure 4:
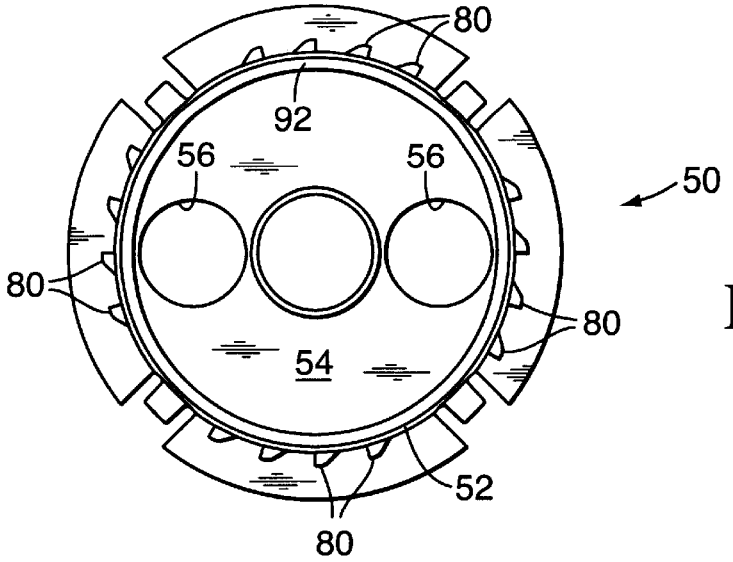
FIGS. 4, 5, 6, 7, and 8, respectively, are top, bottom, elevational, half-sectional, and full cross-sectional views of a fitment of the squeezable, dual-chambered container, which in FIG. 8 is shown in a position rotated by one-quarter turn from its position in FIG. 7.
Figure 12:
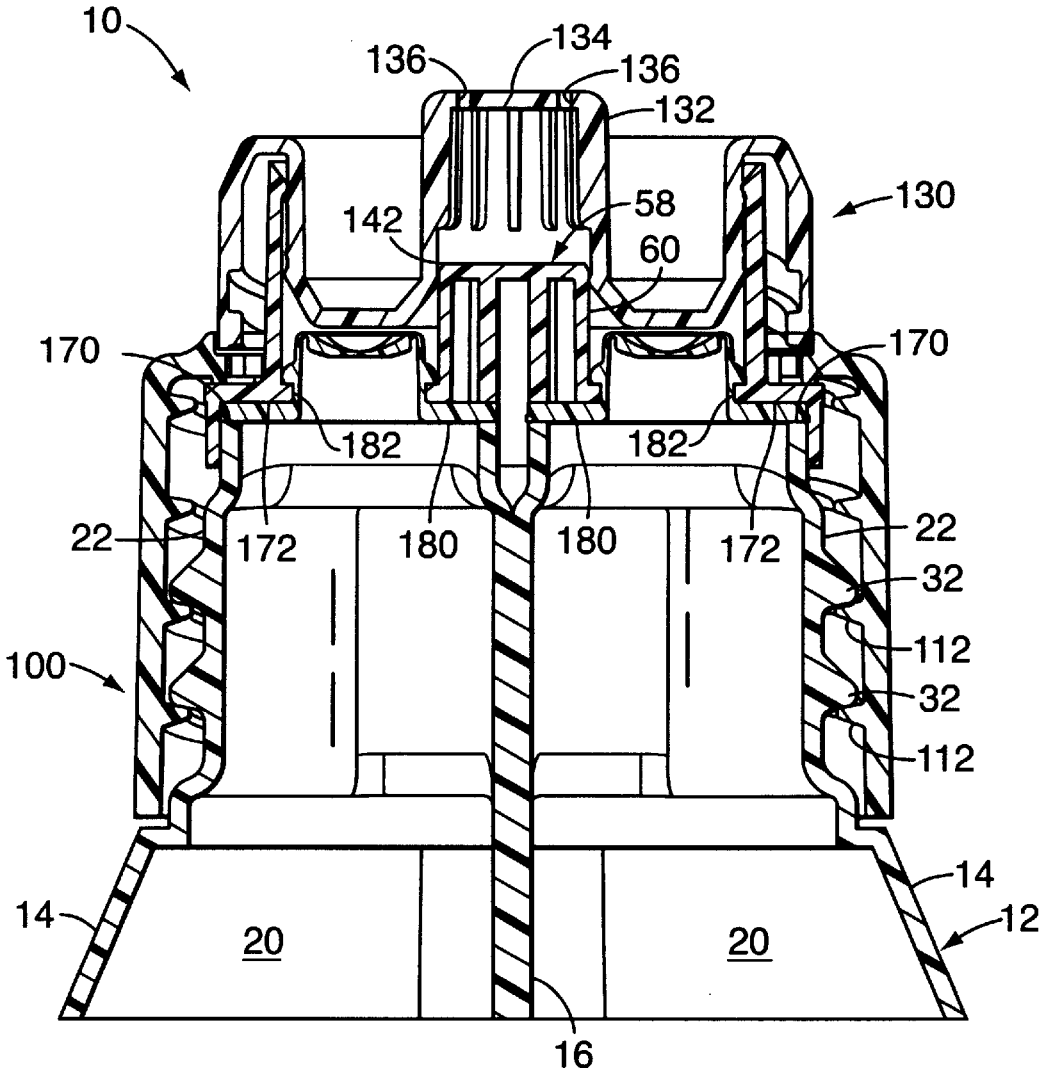
FIGS. 12, 13, and 14, respectively, are fragmentary, cross-sectional views showing the squeezable, dual-chambered container in an upright, closed condition with its valves closed, in an upright, opened condition with its valves closed, and in an inverted, opened condition with its valves opened.

As shown in FIGS. 1, 2, and 3 and in other views, a dispensing system 10 embodying this invention comprises a squeezable, dual-chambered container 12 for mixing two fluent materials and for dispensing the mixed materials. The container 12 has an exterior wall 14 and an interior wall 16 (see FIGS. 3, 12, and 13) defining two storage chambers 20, each for storing one of the fluent materials before mixing and dispensing. Except as shown and described herein, the dispensing system 10 is similar to the dispensing system disclosed in U.S. patent application Ser. No. 09/502,630, supra.

The fluent materials, which are not shown, may be liquids, emulsions, powders, or granules, which may be components of a comestible product, a personal care product, an industrial or household cleaning product, or any of a wide range of similar or dissimilar products.

As shown in FIGS. 2 and 3, each storage chamber 20 has a finish 22 defining an outlet 24. The finishes 22 are arranged in a contiguous pair, which defines an outer surface 26 having two curved portions 28 conforming to a circular cylinder of a given diameter, and two flat portions 30 defining an anti-rotational formation of the finishes 22, and which defines outer threads 32 on the curved portions 28.

As shown in FIGS. 2 and 3, the dispensing system 10 has two valves 40 of a type that remains closed until opened by a differential between inside pressure and outside pressure. Each valve 40 overlies and is aligned with the outlet 24 defined by the finish 22 of an associated one of the storage chambers 20. Details of the valves 40 are to be later described. Except as shown and described herein, the valves 40 are similar to the valves disclosed in U.S. Pat. No. 5,839,614, supra, and in U.S. patent application Ser. No. 09/432,677, supra.

As shown in FIGS. 4 through 8 and in other views, the dispensing system has a fitment 50 having a tubular sleeve 52 defining a mixing chamber 54, in which the fluent materials from the storage chambers 20 are permitted to intermix, and from which the mixed materials are dispensed. The fitment 50 defines two inlets 56 (see FIG. 5) into the mixing chamber 54, each inlet 56 being associated with the outlet 24 defined by an associated one of the storage chambers 20, and a plug head 58 (see FIG. 8) having a tubular wall 60 and a closed end 62.

Figure 6:
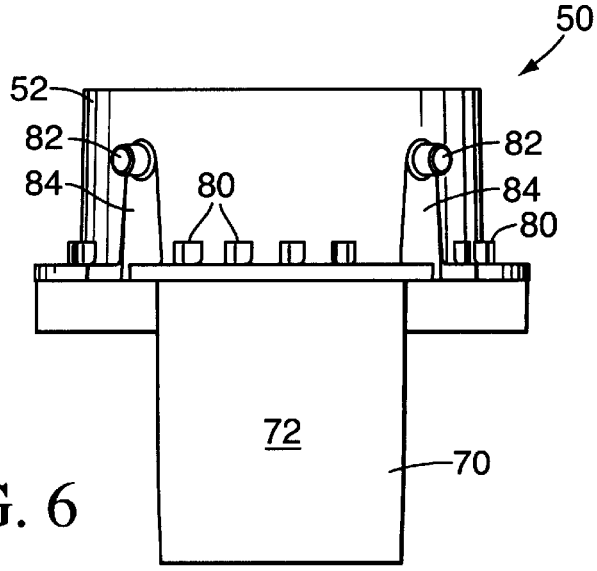
Figure 7:
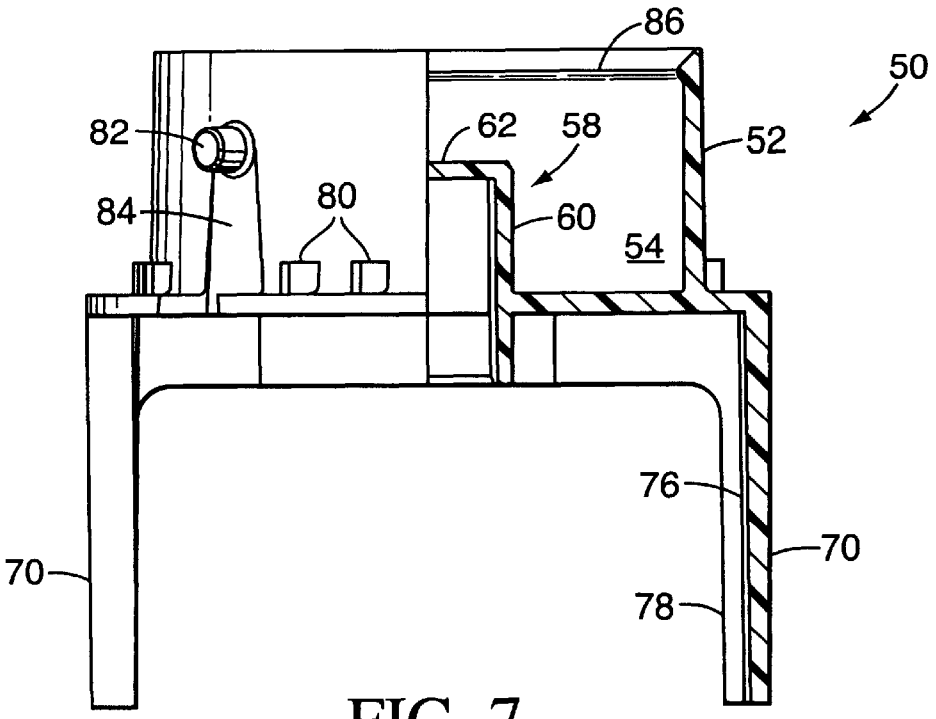
Figure 8:
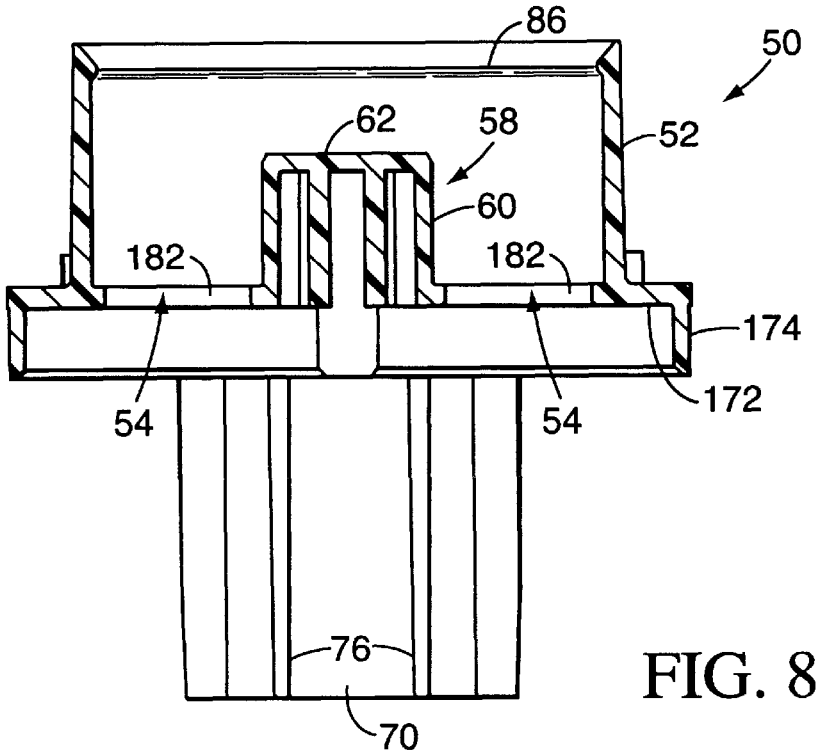

As shown in FIGS. 6, 7, and 8, the fitment 50 has two skirts 70, each having an outer surface 72, which conforms to a common, circular cylinder. Each skirt 70 has an inner surface 74 having at least two axially extending ribs 76, each of which has a flat surface 78 conforming to the flat portions 30 of the outer surface 26 of the finishes 22 and defining an anti-rotational formation of the fitment 50.

The anti-rotational formation of the contiguous pair of the finishes 22 is adapted to engage the anti-rotational formation of the fitment 50 so as to prevent relative rotation of the fitment 50 and the finishes 22 when the antirotational formation of the fitment 50 engages the anti-rotational formation of the finishes 22. Hence, rotational misalignments are prevented.

As shown in FIGS. 3 and 7, the fitment 50 has outer ratchet teeth 80, in an array circumscribing the fitment 50. The fitment 50 has four of cam followers 82, which are spaced circumferentially and each of which projects in a radially outward direction from an axially projecting post 84. The tubular sleeve 52 of the fitment 50 has an annular sealing bead 86, which projects radially inwardly, at a distal end 88 of the tubular sleeve 52.

As shown in FIG. 3, the dispensing system 10 has a collar 100 having an externally knurled skirt 110 defining inner threads 112, which are adapted to engage the outer threads 32 of the contiguous finishes 22 and to hold the fitment 50, when the collar 100 is threaded on to the threads 32 to sandwich the fitment 50 between the collar 100 and container outlet finishes 22. The fitment 50 holds the valves 40 when the fitment 50 is held by the collar 100.

The collar 100 has inner ratchet teeth 120 in an array circumscribing the collar 100. The inner ratchet teeth 120 are adapted to coact with the outer ratchet teeth 80 of the fitment 50 so as to permit the collar 100 to be rotated relative to the fitment 50 when the collar is threaded onto the container outlet finishes 22, but the collar teeth 80 prevent the reverse rotation of the collar 100 relative to the fitment 50 in the unscrewing direction so as to prevent unthreading or unscrewing of the installed collar 100 from the container 12 and removal from container 12 and fitment 50. For some applications, the outer ratchet teeth 80 and the inner ratchet teeth 120 can be optionally omitted, and this will allow the closure system collar 100 and fitment 50 to be removed from the container finishes 22.

Figure 9:
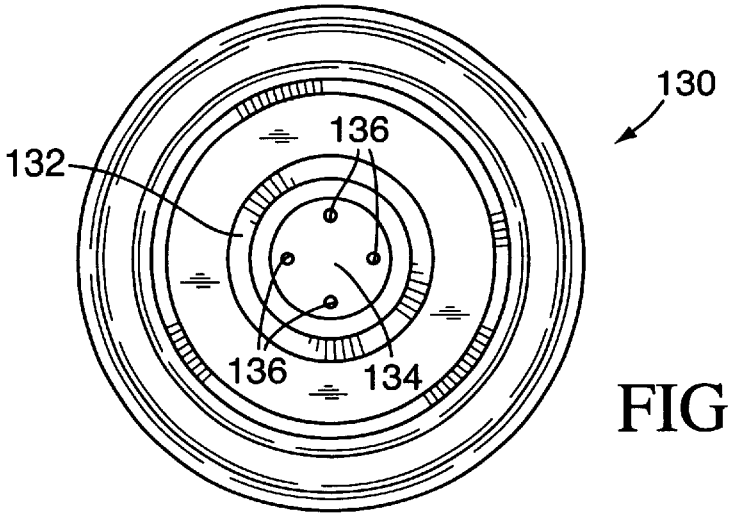
FIGS. 9, 10, and 11, respectively, are top, bottom, and cross-sectional views of a dispensing spout of the squeezable, dual-chambered container.
Figure 11:
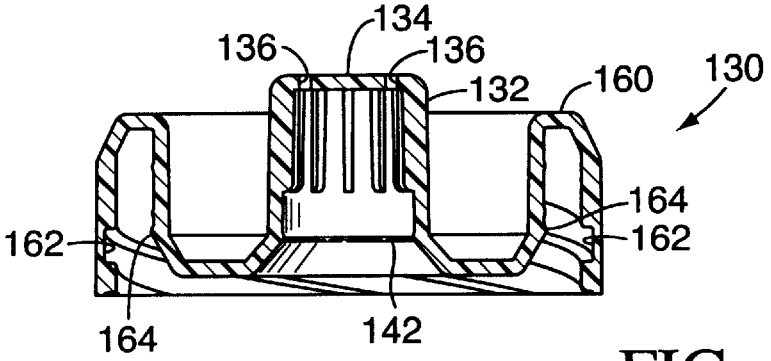
Figure 10:
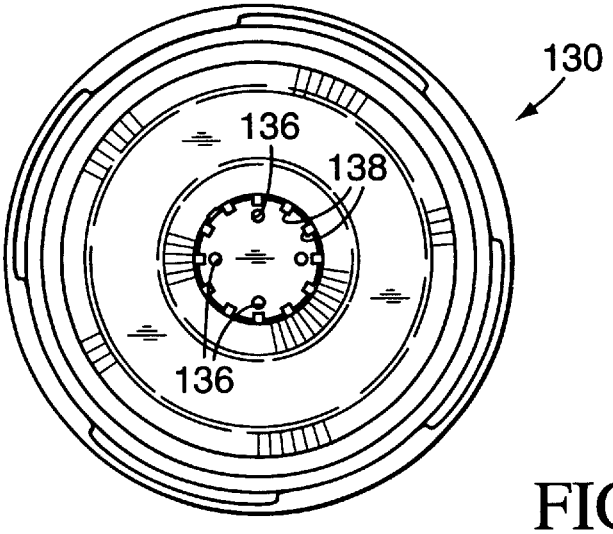

As shown in FIGS. 9, 10, and 11, the dispensing system 10 has a dispensing spout 130, which has a tubular sleeve 132 having a distal end 134 that is closed except for multiple dispensing openings 136. The tubular sleeve 132 of the dispensing spout 130 guides the fluent materials from the mixing chamber 52. Within the tubular sleeve 132, the dispensing spout 130 has an annular, radially inwardly projecting, sealing bead 142, which engages the tubular wall 60 of the plug head 58 of the fitment 50 so as to form what is known in the art as a "shipping seal" in a closed, sealed position of the dispensing spout 130. Such a "shipping seal" serves to seal the container 12 until a user is ready to dispense the fluent materials from the container 12.

Figure 13:
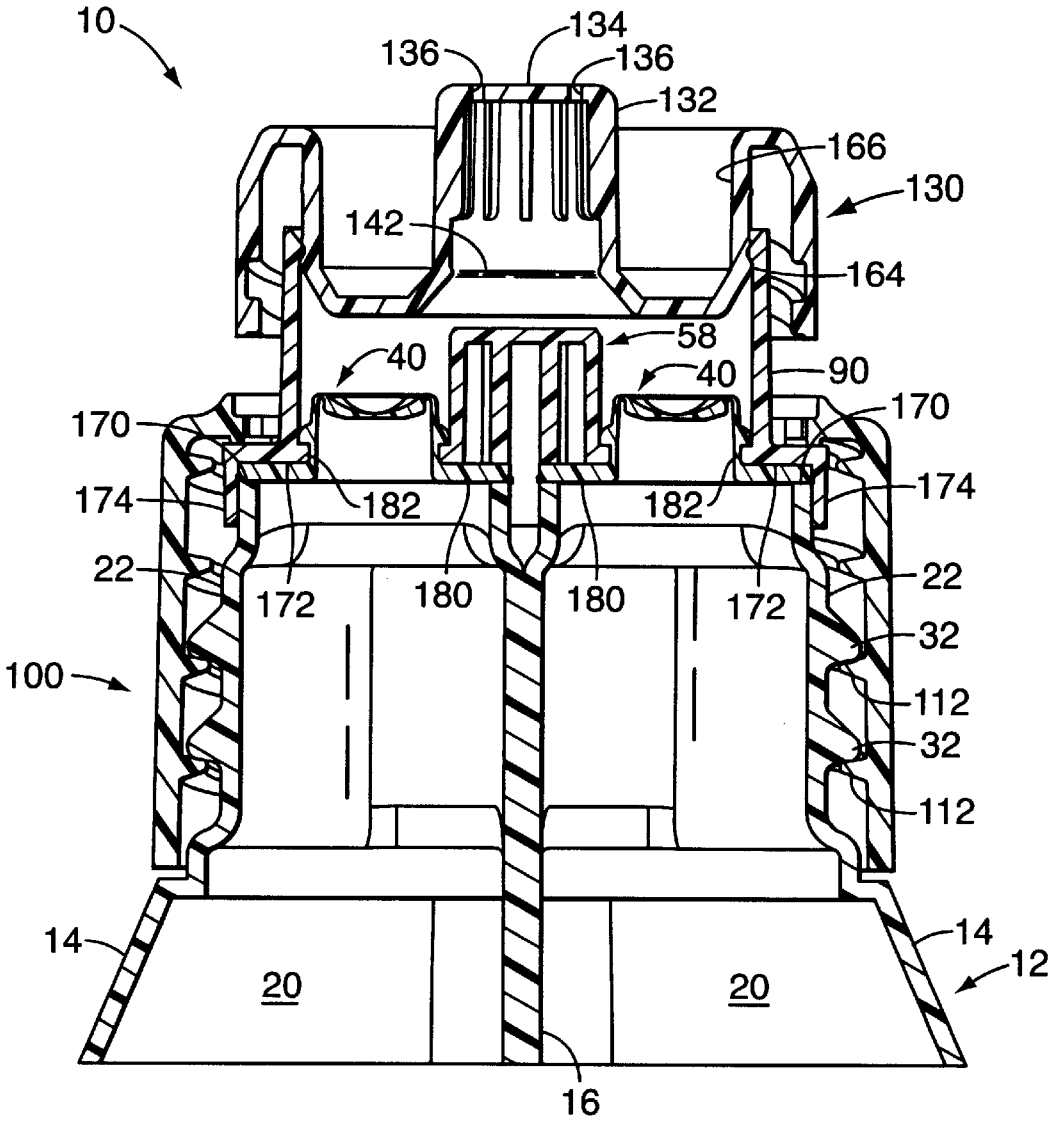

The dispensing spout 130 has an outer, annular structure 160 (see FIG. 11) having inner, helical cam tracks 162, which receive the cam followers 82 of the fitment 50. The cam followers 82 coact with the cam tracks 162, whereby the dispensing spout 130, when turned while the container 12 is held, is movable between the closed, sealed position (FIG. 12), in which the annular sealing bead 142 engages the tubular wall 60 of the plug head 58 of the fitment 50, and an opened, unsealed position (FIG. 13). The outer, annular structure 160 has an annular, radially outwardly projecting bead 164 (see FIG. 11), which is adapted to engage the sealing bead 86 on the tubular sleeve 52 of the fitment 50, so as to limit such movement of the dispensing spout 130 toward the opened, unsealed position. The bead 86 is adapted to snap past the bead 164 when the dispensing spout 130 and the fitment 50 are assembled.

Figure 5:
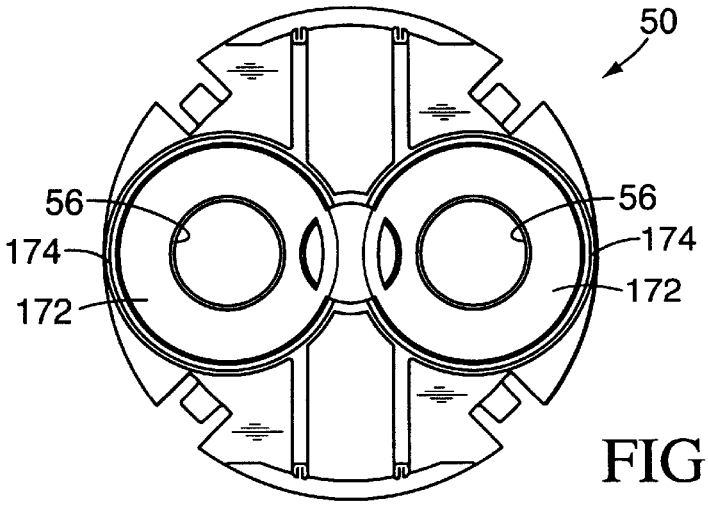

As shown in FIGS. 2, 3, and 5, each finish 22 defines a margin 170 around the outlet 24 defined by said finish 22. As shown in FIGS. 3 and 8, the fitment 50 defines a margin 172 around the fitment inlet 56 associated with the outlet 24 defined by each finish 22. Each valve 40 has an elastomeric flange 180, which is interposed and forms a seal (see FIGS. 12 and 13) between the margin 170 around the outlet 24 defined by the finish 22 of the storage chamber 20 associated with said valve 40 and the margin 172 around the inlet 56 defined by the fitment 50 and associated with said valve 40. Around each inlet 56, the fitment 50 has a partially circumferential flange 174 (see FIG. 8) that partially circumferentially confines the elastomeric flange 180 at said inlet 56. The flange 174 also functions to guide and align the container margin 170 to contact the elastomeric flange 180 while the closure collar 100 is being threaded onto the container finishes 22 over the fitment 50.

As shown in FIGS. 3 and 8, the fitment 50 defines an annular formation 182 extending in a radially inward direction from the margin 172 around each inlet 56 defined by the fitment 50. As shown in FIG. 3, each valve 40 has a valve sleeve 184, which projects axially from the elastomeric flange 180 of said valve 40, and a valve head 190 on the valve sleeve 184 of said valve 40. The valve sleeve 184 of each valve 40 has an outwardly opening, grooved formation 192, which coacts with the annular formation 182 at the margin 172 around the fitment inlet 56 associated with said valve 40 so as to enable the valves 40 to be snap-fitted (see FIGS. 12 and 13) into the fitment 50.

Figure 14:
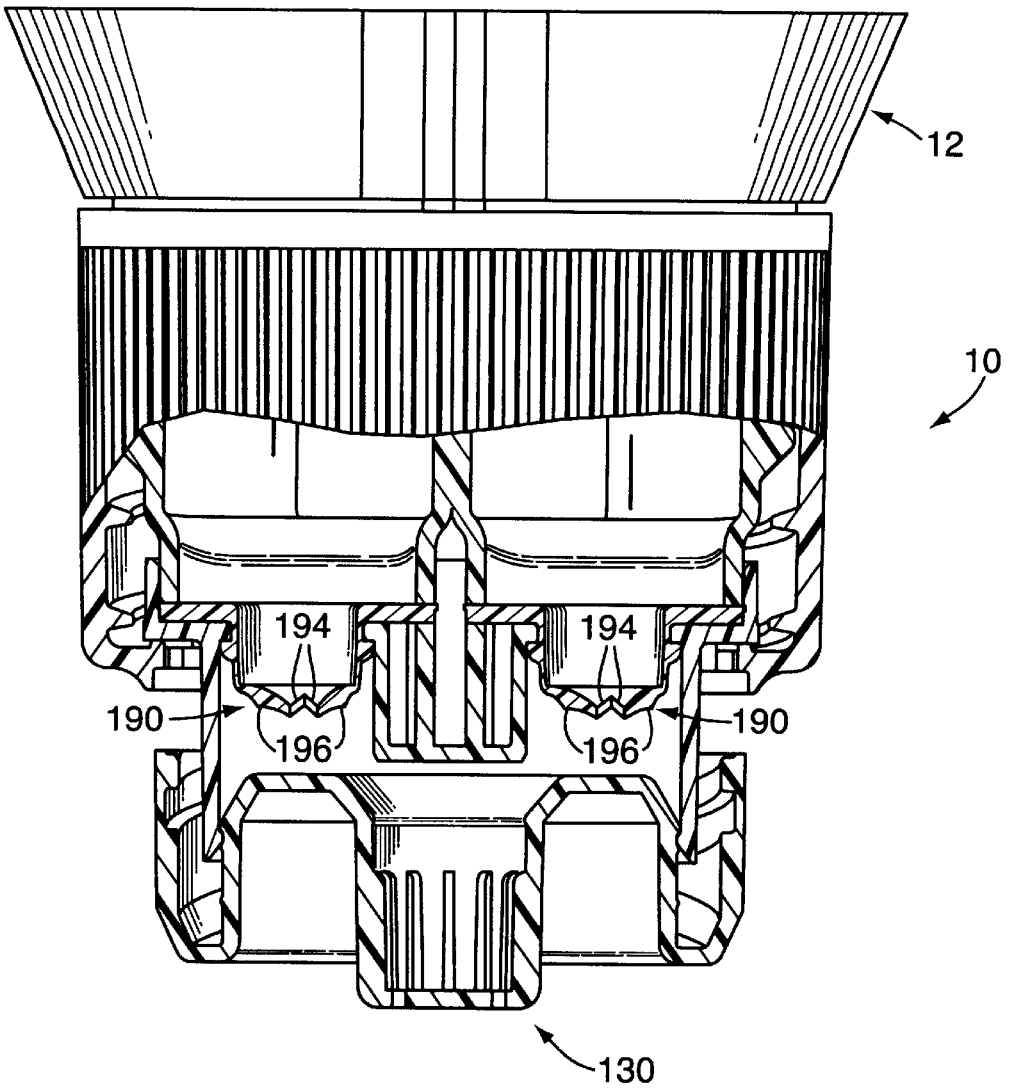

As shown in FIG. 14, the valve head 190 of each valve 40 has two mutually perpendicular, intersecting, dispensing slits 194, which define four generally sector-shaped, flaps or petals 196, which open outwardly so as to open said valve 40 when a differential between inside pressure and outside pressure occurs, as when the squeezable, dual-chambered container 12 is squeezed. Ordinarily, as shown in FIG. 14, the squeezable, dual-chambered container 12 is inverted, when the valves 40 are opened, so as to dispense the fluent materials downwardly into the mixing chamber 54, in which the fluent materials are permitted to intermix before being dispensed through the dispensing spout 130.

It will be readily apparent from the foregoing detained description of a preferred embodiment of this invention and from the illustrations thereof that numerous modifications and variations may be effected without departing from the true spirit and scope of the novel concepts or principles of this invention.

What is claimed is:

1. A dispensing system comprising at least two storage chambers, each of which is designed to contain a fluent material and each of which has a finish defining an outlet, the finishes being arranged in a contiguous group, which defines an outer surface having a portion conforming to a surface of revolution, which defines outer threads on the portion conforming to the surface of revolution, and which defines an anti-rotational formation, at least two valves, each of which overlies and is aligned with the outlet defined by the finish of an associated one of the storage chambers, of a type that remains closed until opened by a differential between inside pressure and outside pressure, a fitment defining a mixing chamber, in which the fluent materials from the storage chambers are permitted to intermix, the fitment defining plural inlets into the mixing chamber and an outlet from the mixing chamber, each inlet being associated with the outlet defined by the finish of an associated one of the storage chambers, the fitment having an anti-rotational formation adapted to engage the anti-rotational formation of the outer surface of the contiguous group of the finishes so as to prevent relative rotation of the fitment and the contiguous group of the finishes when the anti-rotational formation of the fitment engages the anti-rotational formation of the contiguous group of the finishes, the fitment fitting over the valves overlying the outlets and over the contiguous group of the finishes so that each inlet defined by the fitment overlies and is aligned with the valve overlying and being aligned with the associated outlet and so that the anti-rotational formation of the fitment engages the anti-rotational formation of the contiguous group of the finishes, and a collar having a lateral wall having inner threads, which are adapted to engage the outer threads of the contiguous group of the finishes and to hold the fitment, when the collar is threaded over the fitment onto the storage chamber finishes, the fitment holding the valves when the fitment is held onto the finishes by the collar.

2. The dispensing system of claim 1 wherein the outer surface defined by the contiguous group of the finishes has a portion that is flatter than the portion conforming to the surface of revolution and that interrupts the outer threads, wherein the anti-rotational formation of the contiguous group of the finishes comprises the flatter portion, wherein the fitment has a skirt having an inner surface having at least one formation conforming to the flatter portion, and wherein the anti-rotational formation of the fitment comprises the at least one conformation.

3. The dispensing system of claim 1 wherein the outer surface defined by the contiguous group of the finishes has a substantially flat portion that interrupts the outer threads, wherein the anti-rotational formation of the contiguous group of the finishes comprises the substantially flat portion, wherein the fitment has a skirt having an inner surface having at least one, each rib having a substantially flat surface conforming to the substantially flat portion, and wherein the anti-rotational formation of the fitment comprises at least one rib.

4. The dispensing system of claim 1 wherein the outer surface defined by the contiguous group of the finishes has at least two substantially flat portions, each of which interrupts the outer threads, wherein the anti-rotational formation of the contiguous group of the finishes comprises the substantially flat portions, wherein the fitment has at least two skirts, each of which is associated with one of the substantially flat portions defined by the contiguous group of the finishes and each of which has at least one rib, each rib having a substantially flat surface conforming to the substantially flat portion, and wherein the anti-rotational formation of the fitment comprises the at least one rib.

5. The dispensing system of claim 1 wherein the fitment and the collar are configured so that the collar can be threaded onto the storage chamber finishes but cannot be unthreaded from the finishes.

6. The dispensing system of claim 1 wherein the fitment has outer ratchet teeth and the collar has inner ratchet teeth, which coact with the outer ratchet teeth so as to permit the collar to be threaded onto the storage chamber finishes but not to be unthreaded from the finishes.

7. The dispensing system of claim 5 wherein the fitment has a sealing formation, wherein the dispensing system further comprises a dispensing spout, which has a sealing formation engageable with the sealing formation of the fitment to seal the outlet from the mixing chamber and disengageable from the sealing formation of the fitment to open the outlet from the mixing chamber, and which is adapted to dispense materials from the mixing chamber when the outlet from the mixing chamber is opened, and wherein the fitment and the dispensing spout have coacting formations permitting the dispensing spout to be twisted in one rotational sense relative to the fitment so that the sealing formation of the dispensing spout engages the sealing formation of the fitment and permitting the dispensing spout to be twisted in the opposite sense relative to the fitment so that the sealing formation of the dispensing spout is disengaged from the sealing formation of the fitment.

8. The dispensing system of claim 6 wherein the fitment has a sealing formation, wherein the dispensing system further comprises a dispensing spout, which has a sealing formation engageable with the sealing formation of the fitment to seal the outlet from the mixing chamber and disengageable from the sealing formation of the fitment to open the outlet from the mixing chamber, and which is adapted to dispense materials from the mixing chamber when the outlet from the mixing chamber is opened, and wherein the fitment and the dispensing spout have coacting formations permitting the dispensing spout to be twisted in one rotational sense relative to the fitment so that the sealing formation of the dispensing spout engages the sealing formation of the fitment and permitting the dispensing spout to be twisted in the opposite sense relative to the fitment so that the sealing formation of the dispensing spout is disengaged from the sealing formation of the fitment.

9. The dispensing system of claim 1 wherein each finish defines a margin around the outlet defined by said finish, wherein the fitment defines a margin around each inlet defined by the fitment, and wherein each valve has an elastomeric flange interposed and forming a seal between the margin around the outlet defined by the finish of the storage chamber associated with said valve and the margin around the inlet defined by the fitment and associated with said valve.

10. The dispensing system of claim 9 wherein the fitment defines an annular formation extending from the margin of each inlet defined by the fitment, wherein each valve has a valve head at one end of a valve sleeve, which projects from the elastomeric flange of said valve, and wherein the fitment sleeves and the valve sleeves have formations coacting with the annular formations to enable the valves to be snap-fitted into the fitment.

* * * * *